US007151507B1

(12) United States Patent
Herting

(10) Patent No.: US 7,151,507 B1
(45) Date of Patent: Dec. 19, 2006

(54) LOW-LOSS, DUAL-BAND ELECTROMAGNETIC BAND GAP ELECTRONICALLY SCANNED ANTENNA UTILIZING FREQUENCY SELECTIVE SURFACES

(75) Inventor: Brian J. Herting, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 58 days.

(21) Appl. No.: 11/154,256

(22) Filed: Jun. 16, 2005

(51) Int. Cl.
*H01Q 15/02* (2006.01)

(52) U.S. Cl. ..... 343/909; 343/778

(58) Field of Classification Search ..... 343/754, 343/778, 909; 333/157, 248; 342/371–375
See application file for complete search history.

(56) References Cited

U.S. PATENT DOCUMENTS

| | | | | |
|---|---|---|---|---|
| 6,756,866 | B1 | 6/2004 | Higgins | 333/157 |
| 6,806,846 | B1 | 10/2004 | West | 343/909 |
| 6,822,617 | B1 | 11/2004 | Mather et al. | 343/797 |
| 6,822,622 | B1 * | 11/2004 | Crawford et al. | 343/909 |

OTHER PUBLICATIONS

"Characteristics of Ka Band Waveguide Using Electromagnetic Crystal Sidewalls", by J. A. Higgins et al., 2002 IEEE MTT-S International Microwave Symposium, Seattle, WA, Jun. 2002.

U.S. Appl. No. 10/458,481, filed on Jun. 10, 1993 entitled "One-Dimensional and Two Dimensional Electronically Scanned Slotted Waveguide Antennas Using Tunable Band Gap Surfaces" by James B. West et al.

U.S. Appl. No. 10/273,459, filed on Oct. 18, 2002 entitled "A Method and Structure for Phased Array Antenna Interconnect" by John C. Mather et al.

U.S. Appl. No. 10/698,774, filed on Oct. 31, 2003, entitled "Independently Controlled Dual-Mode Analog Waveguide Phase Shifter" by James B. West et al.

U.S. Appl. No. 10/699,514, filed on Oct. 31, 2003, entitled "A Dual-Band Multibeam Waveguide Phased Array" by James B. West et al.

"A Dual-Frequency Band Waveguide Using FSS", R. J. Langley, IEEE Microwave and Guided Wave Letters, vol. 3, No. 1, Jan. 1993.

* cited by examiner

*Primary Examiner*—Michael C. Wimer
(74) *Attorney, Agent, or Firm*—Nathan O. Jensen; Kyle Eppele

(57) ABSTRACT

A dual-band electromagnetic band gap (EBG) electronically scanned antenna utilizing frequency selective surfaces (FSS) uses FSS waveguide phase shifters. Each FSS waveguide phase shifter has a low-frequency phase shifter with low-frequency EBG devices on vertical waveguide walls, horizontal waveguide broadwalls that are substantially twice the width of the vertical waveguide walls and an FSS located at the center of the horizontal waveguide broadwalls. Two high-frequency phase shifters are formed within the low-frequency phase shifter. Each high-frequency phase shifter comprises a vertical waveguide wall, the FSS, half of the horizontal waveguide broadwalls, and high-frequency EBG devices located on each half of the horizontal waveguide broadwalls, The FSS is transparent at a low frequency and opaque at a high frequency.

20 Claims, 6 Drawing Sheets

LOW-LOSS, DUAL-BAND ELECTROMAGNETIC BAND GAP ELECTRONICALLY SCANNED ANTENNA UTILIZING FREQUENCY SELECTIVE SURFACES

CROSS REFERENCE TO RELATED APPLICATIONS AND PATENTS

The present application is related to co-pending application Ser. No. 10/273,459 filed on Oct. 18, 2002 entitled "A Method and Structure for Phased Array Antenna Interconnect" by John C. Mather, Christina M. Conway, and James B. West, U.S. Pat. No. 6,950,062; Ser. No. 10/698,774 entitled "Independently Controlled Dual-Mode Analog Waveguide Phase Shifter" by James B. West and Jonathan P. Doane, abandoned; Ser. No. 10/699,514 entitled "A Dual-Band Multibeam Waveguide Phased Array" by James B. West and Jonathan P. Doane, adandoned; and U.S. Pat. No. 6,822,617 entitled "A Construction Approach for an EMXT-Based Phased Array Antenna" by John C. Mather, Christina M. Conway, James B. West, Gary E. Lehtola, and Joel M. Wichgers. The patent and co-pending applications are incorporated by reference herein in their entirety. All applications and patents are assigned to the assignee of the present application.

BACKGROUND OF THE INVENTION

This invention relates to antennas, phased array antennas, and specifically to a low-loss, dual-band electromagnetic band gap (EBG), electronically scanned antenna (ESA) utilizing frequency selective surfaces (FSS).

Electronically scanned antennas or phased array antennas offer significant system level performance enhancements for advanced communications, data link, radar, and SATCOM systems. The ability to rapidly scan the radiation pattern of the ESA allows the realization of multi-mode operation, LPI/LPD (low probability of intercept and detection), and A/J (antijam) capabilities. One of the major challenges in ESA design is to provide cost effective antenna array phase shifting methods and techniques along with dual-band operation of the ESA.

It is well known within the art that the operation of a phased array is approximated to the first order as the product of the array factor and the radiation element pattern as shown in Equation 1 for a linear array.

$$E_A(\theta) \equiv \underbrace{E_p(\theta, \phi)}_{\substack{Radiation\\Element\\Pattern}} \underbrace{\left[\frac{\exp\left(-j\frac{2\pi r_o}{\lambda}\right)}{r_o}\right]}_{\substack{Isotropic\\Element\\Pattern}} \cdot \underbrace{\sum_N A_n \exp\left[-j\frac{2\pi}{\lambda} n\Delta x(\sin\theta - \sin\theta_o)\right]}_{Array\ Factor} \qquad \text{Equation 1}$$

Standard spherical coordinates are used in Equation 1 and θ is the scan angle referenced to bore sight of the array. Introducing phase shift at all radiating elements within the array changes the argument of the array factor exponential term in Equation 1, which in turns steers the main beam from its nominal position. Phase shifters are RF devices or circuits that provide the required variation in electrical phase. Array element spacing is related to the operating wavelength and it sets the scan performance of the array. All radiating element patterns are assumed to be identical for the ideal case where mutual coupling between elements does not exist. The array factor describes the performance of an array of isotropic radiators arranged in a prescribed two-dimensional rectangular grid.

A packaging, interconnect, and construction approach is disclosed in U.S. Pat. No. 6,822,617 entitled "A Construction Approach for EMXT-Based Phased Array Antenna" that creates a cost-effective EMXT (electromagnetic crystal)-based phased array antennas having multiple active radiating elements in an X-by-Y configuration. EMXT devices are also known in the art as tunable photonic band gap (PBG) and tunable electromagnetic band gap (EBG) substrates. A description of a waveguide section with tunable EBG phase shifter technologies is available in a paper by J. A. Higgins et al. "Characteristics of Ka Band Waveguide using Electromagnetic Crystal Sidewalls" 2002 IEEE MTT-S International Microwave Symposium, Seattle, Wash., June 2002 and U.S. Pat. No. 6,756,866 "Phase Shifting Waveguide with Alterable Impedance Walls and Module Utilizing the Waveguides for Beam Phase Shifting and Steering" by John A. Higgins. Each element is comprised of EMXT sidewalls and a conductive (metallic) floor and ceiling. Each EMXT device requires a bias voltage plus a ground connection in order to control the phase shift for each element of the antenna by modulating the sidewall impedance of the waveguide. By controlling phase shift performance of the elements, the beam of the antenna can be formed and steered.

Phase shifter operation in dual modes in one common waveguide with independent phase control for each mode at the same or different frequency bands for phased array antennas and other phase shifting applications is a desirable feature to increase performance and reduce cost and size. Dual bands of current interest include K Band (20 GHz) and Q Band (44 GHz) for satellite communication (SATCOM) initiatives.

Dual-band EBG ESA antennas are constructed of square EBG waveguide phase shifters. The waveguide aperture size is determined so as to maximize phase shift while minimizing loss. Smaller apertures yield greater phase shift per unit length, but higher loss due to input mismatch. As the frequencies of a dual-band EBG ESA are made further apart, the task of achieving low-loss 360° phase shifter performance becomes daunting.

What is needed is a low-cost, low-loss, dual-band EBG ESA waveguide antenna utilizing techniques that enable dual frequency operation at widely different frequencies.

SUMMARY OF THE INVENTION

A dual-band electromagnetic band gap (EBG) electronically scanned antenna (ESA) utilizing frequency selective surfaces (FSS) comprising a plurality of FSS waveguide phase shifters is disclosed.

The dual-band EBG ESA has low-frequency phase shifters and high-frequency phase shifters. Each of the low-frequency phase shifters contains two high-frequency phase shifters separated by a frequency selective surface. A low-frequency phase shifter has approximately double an aperture size of a high-frequency phase shifter.

Each of the FSS waveguide phase shifters comprises the low-frequency phase shifter that has low-frequency EBG devices on vertical waveguide walls, horizontal waveguide broadwalls that are substantially twice the width of the vertical waveguide walls, and a frequency selective surface located at the center of the horizontal waveguide broadwalls. The frequency selective surface is transparent at a low frequency. Each of the FSS waveguide phase shifters also comprises the two high-frequency phase shifters formed within the low-frequency phase shifter. Each high-frequency phase shifter comprises a vertical waveguide wall, the frequency selective surface, half of the horizontal waveguide broadwalls, and high-frequency EBG devices located on each half of the horizontal waveguide broadwalls. The frequency selective surface is opaque at a high frequency.

The frequency selective surface may be a periodic surface of identical elements that exhibits a frequency dependent behavior. The frequency selective surface comprises a plurality of unit cells etched on high-frequency material substrates. The frequency selective surfaces may be disposed on an FSS slat that extends vertically through the FSS ESA such that every other slat of the dual-band EBG ESA is an FSS slat.

It is an object of the present invention to provide a dual-band EBG ESA utilizing frequency selective surfaces.

It is an object of the present invention to provide independent control of phase shift for modes operating at the same or different frequencies in an ESA.

It is an advantage of the present invention to provide low-loss, dual-polarization operation at widely spaced frequencies.

It is an advantage of the present invention to provide a low-frequency phase shifter with approximately double the aperture size of a high frequency phase shifter.

It is a feature of the present invention to provide the benefit of independent beamsteering for dual modes and frequencies.

It is a feature of the present invention to provide a low-cost dual-band EBG ESA with simple construction.

BRIEF DESCRIPTION OF THE DRAWINGS

The invention may be more fully understood by reading the following description of the preferred embodiments of the invention in conjunction with the appended drawings wherein.

DETAILED DESCRIPTION

The present invention is for a dual-band electromagnetic band gap (EBG) electronically scanned antenna (ESA) using frequency selective surfaces (FSS).

Figure 1:
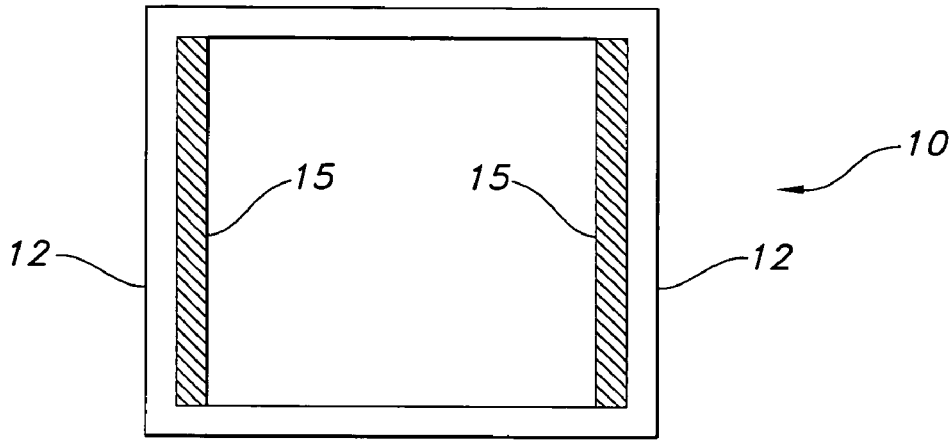
FIG. 1 (PRIOR ART)
FIG. 1 is a diagram of a single-mode analog waveguide phase shifter using electromagnetic band gap (EBG) device sidewalls.

A single-mode analog waveguide phase shifter 10 using electromagnetic band gap (EBG) devices 15 on waveguide sidewalls 12 is shown in FIG. 1 and is described in the referenced paper by J. A. Higgins et al. "Characteristics of Ka Band Waveguide using Electromagnetic Crystal Sidewalls" and disclosed in U.S. Pat. No. 6,756,866. The references describe electromagnetic crystal (EMXT) devices implemented with EBG materials. EBG materials are periodic dielectric materials that forbid propagation of electromagnetic waves in a certain frequency range. The EBG material may be GaAs, ferroelectric, ferromagnetic, or any suitable EBG embodiment. EMXT device and EBG device are used interchangeably in the following description.

Figure 2A:
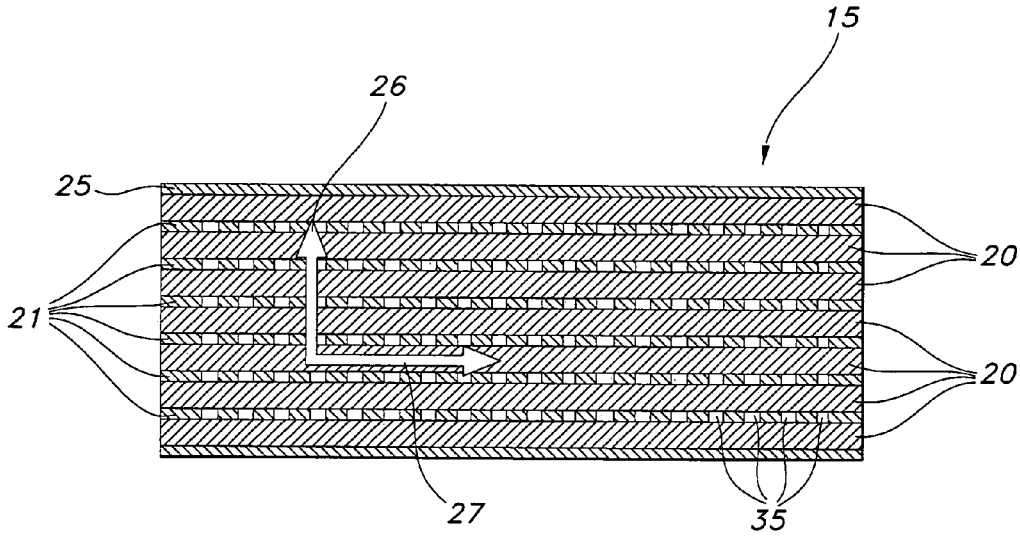
FIG. 2a (PRIOR ART)
FIG. 2*a* is a top view of an electromagnetic band gap device sidewall used in the waveguide phase shifter of FIG. 1.
Figure 2B:
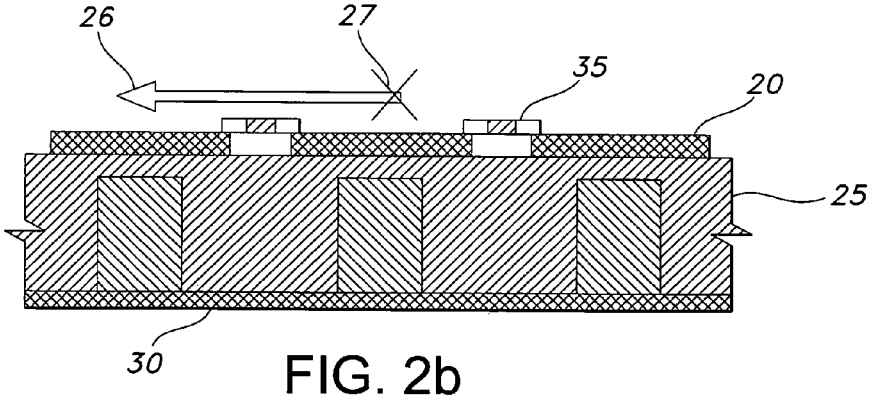
FIG. 2b (PRIOR ART)
FIG. 2*b* is a physical cross section view of the electromagnetic band gap device of FIG. 2*a;*
Figure 2C:
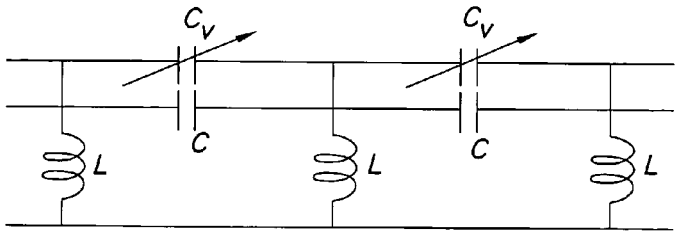
FIG. 2c (PRIOR ART)
FIG. 2*c* is an electrical circuit representation of the electromagnetic band gap device of FIGS. 2*a* and 2*b;*
Figure 3:
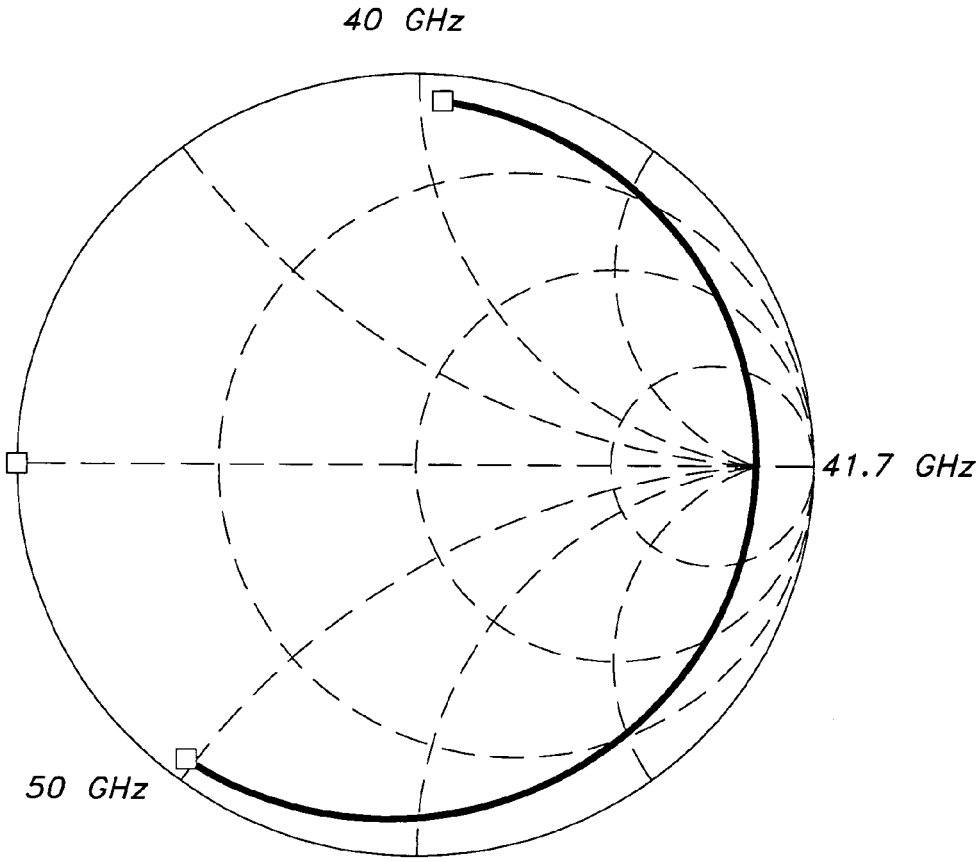
FIG. 3 is a Smith chart showing high impedance at resonance of the electromagnetic band gap devices.

The waveguide sidewalls 12 of the single-mode EBG waveguide phase shifter 10 each contain an EBG device 15 that consists of a periodic surface of conductive strips 20 that may be metal separated by gaps 21 over a surface of a dielectric substrate 25 as shown in FIG. 2*a* and FIG. 2*b*. These strips 20 capacitively couple to each other, and inductively couple to a ground plane 30 on an opposite surface of the substrate 25 as shown in FIG. 2*b*. This structure creates a LC tank circuit shown in FIG. 2*c* that resonates at a desired frequency. Near the desired resonant frequency, the EBG device 15 surface appears as a high impedance to a wave traveling down the waveguide as shown in FIG. 3, thus allowing a tangential electric field to exist on the EBG sidewall. Since the high impedance also limits current flow, the tangential magnetic field is forced to zero. The fundamental mode of such a structure is therefore TEM (transverse electromagnetic) having a uniform vertical electric field shown by arrow 26 and a uniform horizontal magnetic field (not shown), both transverse to the direction of propagation shown by arrow 27 in FIG. 2*b*.

Various methods of tuning the EBG device 15 exist. The most developed is a plurality of reactive devices 35 such as varactor or Schotkky diodes placed periodically between the strips 20 to vary a reactance. By adjusting a reverse bias voltage on the diodes 35 applied via the conductive metallic strips 20 from a control source (not shown), the capacitive coupling between the strips 20 is altered as shown by a variable capacitor Cv in FIG. 2*c*, and the overall surface impedance of the EBG device 15 shifts. With a shift in the surface impedance of the EBG devices 15 on the waveguide sidewalls 12, the propagation velocity of the wave is also modulated. The insertion phase of the element can therefore be actively controlled, resulting in a 360° analog phase shifter, for a sufficiently long element.

The tunable EBG device 15 may be implemented in semiconductor MMIC (monolithic microwave integrated circuit) technology. Gallium arsenide (GaAs) and indium phosphide (InP) semiconductor substrates 25 are currently practical, but other III–V compounds are feasible. In these implementations the semiconductor substrate 25 acts as a passive (non-tunable) dielectric material, and tunability is obtained with the reactive devices 35 such as varactor or Schotkky diodes in FIG. 2*b* connected across the conductive strips 20. The semiconductor device tuning elements, the top side metal geometries and the back side bias control signal line interconnections are all realized by means of commonly know semiconductor fabrication techniques.

Ferroelectric and ferromagnetic tunable EBG substrates may be used in the EMXT device 15 as the dielectric substrate 25 of FIGS. 2*a* and 2*b*. Here the dielectric constant and the permeability are varied with a bias applied to the conductive strips 20 to tune the EMXT device 15. Metal deposition techniques are used to form the required top-side metallic geometries and back side bias control signal line interconnections.

Ferroelectric and ferromagnetic materials are known to exhibit electrical parameters of relative permittivity and/or permeability that can be altered or tuned by means of an external stimulus such as a DC bias field. It should be noted, however, that the concepts described herein are equally applicable to any materials that exhibit similar electrical material parameter modulation by means of an external stimulus signal.

Substrates with adjustable material parameters, such as ferroelectric or ferromagnetic materials can be fabricated monolithically, i.e. in a continuous planar substrate without segmentation or subassemblies, through thin film deposition, ceramic fabrication techniques, or semiconductor wafer bulk crystal growth techniques. An example of bulk crystal growth is the Czochralski crystal pulling technique that is known within the art to grow germanium, silicon and a wide range of compound semiconductors, oxides, metals, and halides.

EMXT devices may be fabricated on soft substrates such as high-frequency material substrates using printed circuit techniques. A standard printed circuit board print and etch technique may be used to pattern the EMXT surface metal. The tuning devices may then be placed on the substrate using any automated placement technique such as standard pick and place or fluidic self assembly.

Figure 4:
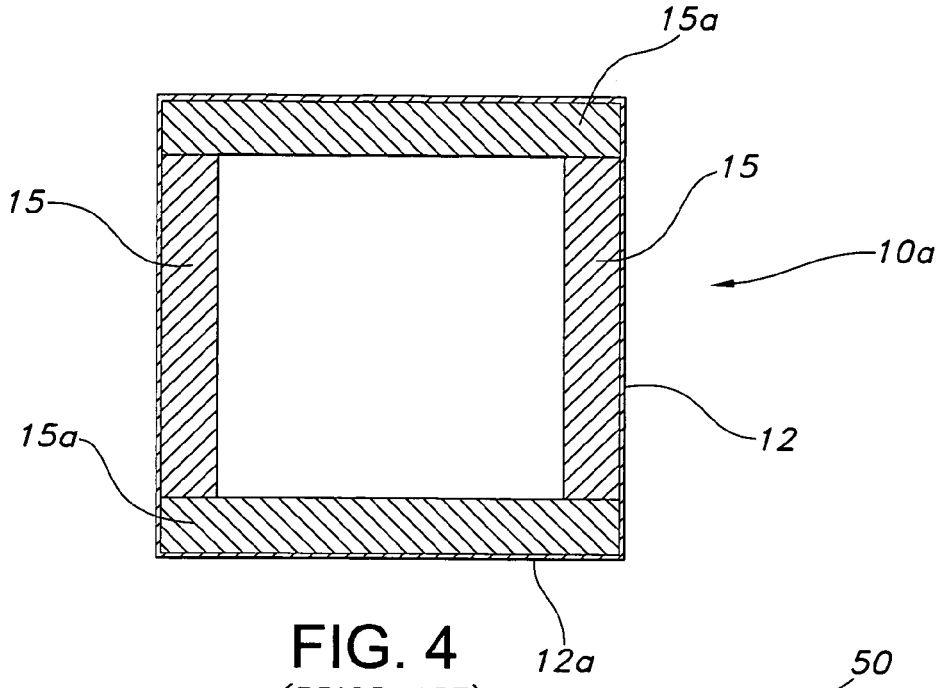
FIG. 4 (PRIOR ART)
FIG. 4 shows the waveguide phase shifter of FIG. 1 modified into a dual-band phase shifter with EBG devices on vertical waveguide walls of a square waveguide for low-frequency operation and EBG devices on horizontal waveguide walls for high-frequency operation.

FIG. 4 shows the waveguide phase shifter 10 of FIG. 1 modified into a dual-band phase shifter 10*a* having EBG devices 15 on vertical waveguide walls 12 of a square waveguide for low-frequency ($f_{lower}$) operation and EBG devices 15*a* on horizontal waveguide walls 12*a* for high-frequency ($f_{upper}$) operation as disclosed in co-pending application Ser. No. 10/698,774 entitled "Independently Controlled Dual-Mode Analog Waveguide Phase Shifter" and Ser. No. 10/699,514 entitled "A Dual-Band Muitibeam Waveguide Phased Array". U.S. Pat. No. 6,756,866 suggests adding EBG to all four walls for dual-mode operation.

Figure 5:
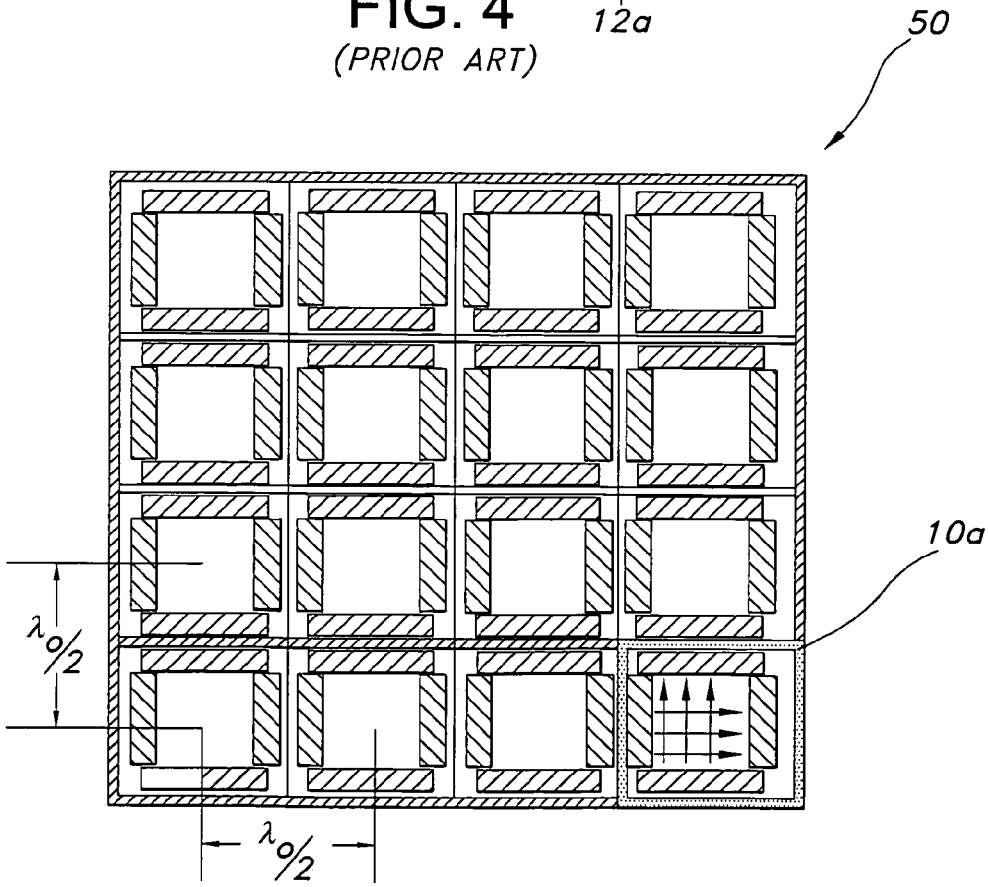
FIG. 5 (PRIOR ART)
FIG. 5 shows the waveguide phase shifters of FIG. 4 combined into an electronically scanned antenna (ESA)

The waveguide phase shifters 10*a* may be combined into an ESA 50 shown in FIG. 5. The waveguide phase shifter 10*a* utilizes the same size waveguide aperture for both modes and frequencies of operation in the ESA 50. The ESA 50 works well when $f_{lower}$ and $f_{upper}$ are closely spaced in terms of wavelength. When $f_{lower}$ and $f_{upper}$ are widely spaced, the aperture size necessary at $f_{upper}$ for grating lobe suppression in the ESA 50 forces the cross section of the low frequency phase shifter to be narrow in terms of wavelength. This creates a situation in which the waveguide is so far into cutoff at $f_{lower}$ that large losses result. This occurs with MILSTAR frequencies such as 20 and 44 GHz.

Figure 6:
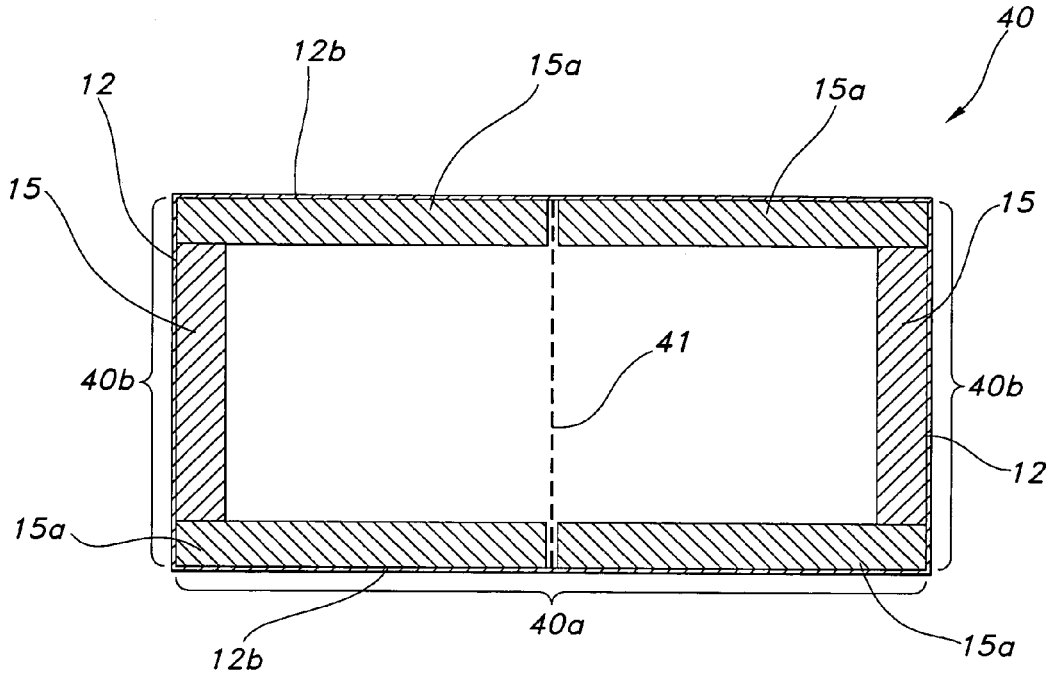
FIG. 6 shows a low-loss, dual-band EBG phase shifter of the present invention, that has a frequency selective surface (FSS) that is opaque at a high frequency and transparent at a low frequency.

A low-loss, dual-band EBG phase shifter 40 of the present invention, shown in FIG. 6, utilizes a surface 41 that is opaque at $f_{upper}$ and transparent at flower such that a horizontal broadwall 12*b* of the waveguide at $f_{lower}$ is substantially doubled over the horizontal waveguide wall 12*a* of FIG. 4, thereby approximately doubling an aperture size at $f_{lower}$ while maintaining a necessary aperture size at $f_{upper}$. Each waveguide width is now effectively the same in terms of wavelength for 20/44-GHz operation. Consequently, the present invention enables low-loss, dual-polarization operation at widely spaced frequencies.

The low-loss, dual-band EBG phase shifter 40 of the present invention is shown in FIG. 6 with horizontal broadwalls 12*b* that are double the width of the vertical walls 12 and the horizontal waveguide walls 12*a*. Other configurations are possible where horizontal broadwalls 12*b* may be more or less than double the vertical wall 12 and still be within the scope of the present invention. The selection of the horizontal broadwall 12*b* width is dependent on frequencies of operation and other technical considerations such as grating lobe suppression.

Figure 7:
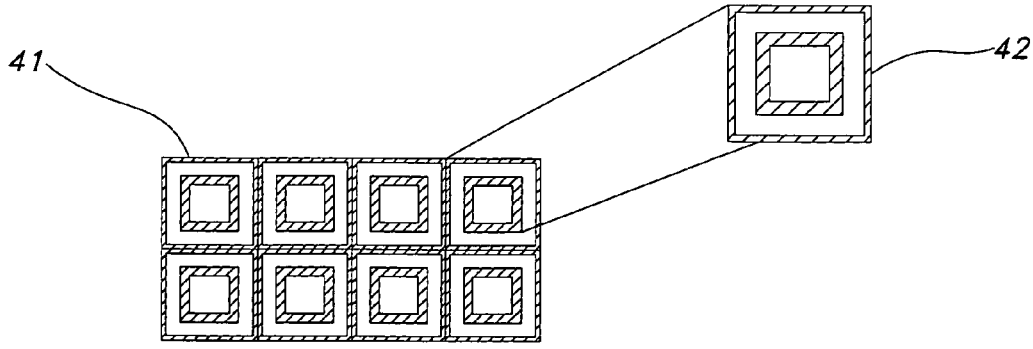
FIG. 7 is a diagram showing an example frequency selective surface with a pattern that may be etched on a high-frequency material substrate.

In order to enable the present invention, the surface 41 that appears opaque at $f_{upper}$ and transparent at $f_{lower}$ must be designed for use as a sidewall. Frequency selective surfaces (FSS) are known in the art and offer a simple method by which to achieve the surface 41. An FSS is a periodic surface of identical elements that exhibits a frequency dependent behavior. The FSS 41 may be formed on high-frequency material substrates using printed circuit techniques. A pattern that may be etched on the FSS 41 is shown in FIG. 7 to create the FSS 41 for the present invention. In FIG. 7 the FSS 41 is made up of a plurality of unit cells having an etched square. Other shapes may be used to form the FSS 41.

Referring back to FIG. 6, the low-loss, dual-band EBG phase shifter 40, hereinafter referred to as an FSS phase shifter 40 has low-frequency EBG devices 15 on the vertical waveguide walls 12 along with horizontal waveguide broadwalls 12*b* that are substantially twice the width of the vertical waveguide walls 12 and the horizontal waveguide walls 12*a* of FIG. 4 to form a low-frequency phase shifter 40*a*. The FSS 41, located at the center of the horizontal waveguide broadwalls 12*b*, appears transparent at the low frequency. Two high-frequency phase shifters 40*b* are formed in the FSS phase shifter 40. Each high-frequency phase shifter 40*b* comprises a vertical waveguide wall 12, the FSS 41, half of the horizontal broadwalls 12*b*, and high-frequency EBG devices 15*a* on half of the horizontal broadwalls 12*b*. The FSS 41 is common to both high-frequency phase shifters 40*b* and is opaque at the high frequency of operation. The FSS phase shifter 40 is a lower cost solution than that shown in FIG. 4 for an ESA due to the reduction in EBG devices 15 at $f_{lower}$.

Figure 8:
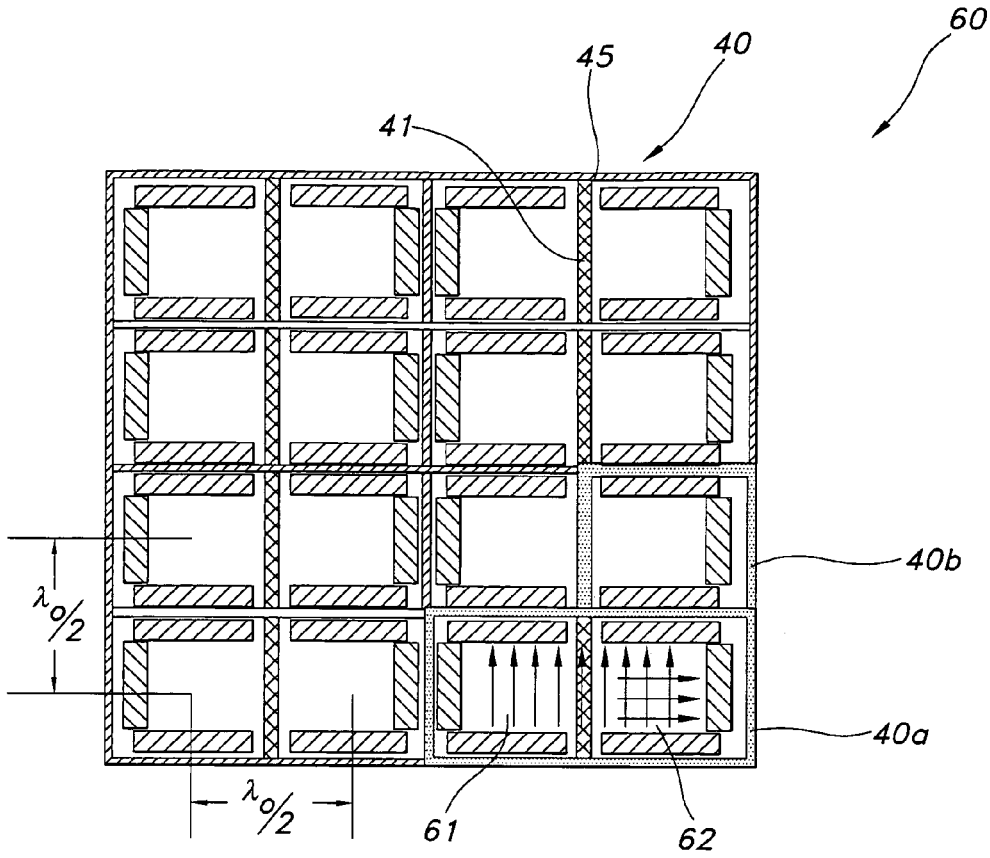
FIG. 8 is a diagram showing the FSS phase shifters combined into a low-loss, dual-band, EBG ESA of the present invention.

FSS phase shifters 40 may be combined into a low-loss, dual-band, EBG FSS ESA 60 of the present invention shown in FIG. 8. The FSS ESA 60 is shown with eight FSS phase shifters 40 in FIG. 8 but any number may be used. The FSS ESA 60 comprises eight low-frequency phase shifters 40*a* and sixteen high-frequency phase shifters 40*b* in the configuration shown in FIG. 8. The FSS 41 for each FSS phase shifter 40 may be an FSS slat 45 that extends vertically through the FSS ESA 60 when using the construction techniques of U.S. Pat. No. 6,822,617. Every other slat of the FSS ESA 60 is an FSS slat 45.

An FSS ESA 60 can be constructed using a plurality of FSS phase shifters 40 by arranging them in a grid with common walls and controlling the phase shift of each phase shifter 40 as shown in FIG. 8. Each FSS phase shifter 40 is a TEM open-ended waveguide with a fully integrated 360-degree analog phase shifter capable of operating simultaneously at two independent frequencies. The entire ESA structure 60 is capable of forming two independently steerable beams in two different frequency bands such as 20/44 GHz SATCOM. In FIG. 8, arrows 61 show polarization of the electric field for the low frequency and arrows 62 show polarization of the electric field for the high frequency.

The FSS ESA 60 may be constructed as a space-fed lens. A dual-band feed horn (not shown) may be used to illuminate one face of the ESA 60 supplying a signal to each FSS phase sifter 40 spatially. Each FSS phase shifter 40 then applies the required amount of phase shift to steer a radiated beam to a desired direction. A spatial feed is a common low-cost method that has the advantage of simplicity and minimal RF interconnects.

The FSS ESA 60 may also be implemented using a constrained or semi-constrained feed (not shown). In this scheme, a signal is individually routed to each FSS 40 by a waveguide or other transmission line. This method, although being more complex and requiring a greater amount of RF interconnect, has the advantage of being more physically compact and generally has less degradation due to mutual coupling.

Because of the nature of the FSS phase shifter 40, the two modes must be orthogonally polarized as shown in FIG. 8. One mode is vertical linear 61, and the other is horizontal linear 62. An additional enhancement that can be added to the antenna 60 is a polarizing surface (not shown). This polarizing surface converts linear polarization to circular polarization, allowing one mode to use left-handed circular (LHC) polarization, and the other right-handed circular (RHC) polarization.

The FSS ESA 60 of FIG. 8 may be constructed used an approach disclosed in U.S. Pat. No. 6,822,617 entitled "A Construction Approach for EMXT-Based Phased Array Antenna." This patent describes a construction approach for a single-band phased array antenna. The approach can easily be expanded to a dual-mode FSS ESA by adding active circuitry in both the rows and the columns, allowing EBG devices on the row slats to be biased in the same manner as the devices on the column slats.

It is believed that a low-loss, dual-band electromagnetic band gap electronically scanned antenna utilizing frequency selective surfaces of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A dual-band electromagnetic band gap (EBG) electronically scanned antenna (ESA) utilizing frequency selective surfaces (FSS), comprising a plurality of FSS waveguide phase shifters, each of said FSS waveguide phase shifters comprising:

a low-frequency phase shifter comprising low-frequency EBG devices on vertical waveguide walls, horizontal waveguide broadwalls that are greater than the width of the vertical waveguide walls and a frequency selective surface located at the center of the horizontal waveguide broadwalls; and two high-frequency phase shifters formed within the low-frequency phase shifter wherein each high-frequency phase shifter comprises a vertical waveguide wall, the frequency selective surface, half of the horizontal waveguide broadwalls, and two high-frequency EBG devices located on each half of the horizontal waveguide broadwalls.

2. The dual-band EBG ESA of claim 1 wherein the frequency selective surface comprises a periodic surface of identical elements that is transparent at a low frequency and is opaque at a high frequency.

3. The dual-band EBG ESA of claim 2 wherein the frequency selective surface comprises a plurality of unit cells etched on high-frequency material substrates.

4. The dual-band EBG ESA of claim 1 wherein the low-frequency EBG and the high-frequency EBG devices each comprise:

a dielectric substrate;

a plurality of conductive strips periodically located on a surface of the dielectric substrate; and a ground plane located on a surface opposite the plurality of conductive strips on the dielectric substrate.

5. The dual-band EBG ESA of claim 4 wherein the EBG devices further comprise a plurality of reactive devices placed between the conductive strips to vary reactance between the conductive strips thereby varying a surface impedance of the EBG devices to shift a phase.

6. The dual-band EBG ESA of claim 4 wherein the dielectric substrate is a ferroelectric substrate having a dielectric constant varied with a bias applied to the plurality of conductive strips to shift a phase.

7. The dual-band EBG ESA of claim 4 wherein the dielectric substrate is a ferromagnetic substrate having a permeability varied with a bias applied to the plurality of conductive strips to shift a phase.

8. A dual-band electromagnetic band gap (EBG) electronically scanned antenna (ESA) utilizing frequency selective surfaces (FSS) comprising a plurality of FSS waveguide phase shifters having low-frequency phase shifters and high-frequency phase shifters, wherein each of the low-frequency phase shifters contains two high-frequency phase shifters therein, separated by a frequency selective surface, and wherein a low-frequency phase shifter has approximately double an aperture size of a high-frequency phase shifter.

9. The dual-band EBG ESA of claim 8 wherein each of said FSS waveguide phase shifters comprises:

the low-frequency phase shifter comprising low-frequency EBG devices on vertical waveguide walls, horizontal waveguide broadwalls that are substantially twice the width of the vertical waveguide walls and a frequency selective surface located at the center of the horizontal waveguide broadwalls wherein said frequency selective surface is transparent at a low frequency; and the two high-frequency phase shifters formed within the low-frequency phase shifter wherein each high-frequency phase shifter comprises a vertical waveguide wall, the frequency selective surface, half of the horizontal waveguide broadwalls, and high-frequency EBG devices located on each half of the horizontal waveguide broadwalls, wherein the frequency selective surface is opaque at a high frequency.

10. The dual-band EBG ESA of claim 9 wherein the frequency selective surface comprises a periodic surface of identical elements that exhibits a frequency dependent behavior.

11. The dual-band EBG ESA of claim 10 wherein the frequency selective surface comprises a plurality of unit cells etched on high-frequency material substrates.

12. The dual-band EBG ESA of claim 8 wherein the frequency selective surfaces are disposed on an FSS slat that extends vertically through the FSS ESA such that every other slat of the dual-band EBG ESA is an FSS slat.

13. A dual-band electromagnetic band gap (EBG) electronically scanned antenna (ESA) utilizing frequency selective surfaces (FSS) comprising a plurality of FSS waveguide phase shifters wherein each of said FSS waveguide phase shifters comprises:

two vertical waveguide sidewalls each having a low-frequency electromagnetic band gap (EBG) devices thereon wherein said low-frequency EBG devices shift phase of a low frequency; and two horizontal waveguide broadwalls each being substantially twice a width of a vertical waveguide sidewall and having two high-frequency EBG devices thereon wherein said high-frequency EBG devices shift phase of a high frequency; and the frequency selective surface disposed perpendicular to and centered on the horizontal waveguide sidewalls.

14. The dual-band EBG ESA of claim 13 wherein the frequency selective surface is opaque at the high frequency and transparent at the low frequency.

15. The dual-band EBG ESA of claim 13 wherein the two vertical waveguide sidewalls with low-frequency EBG devices thereon and the two horizontal waveguide broadwalls form a low-frequency phase shifter.

16. The dual-band EBG ESA of claim 14 wherein the two vertical waveguide sidewalls, the frequency selective surface, and the two horizontal waveguide broadwalls with high-frequency EBG devices thereon form two high-frequency phase shifters.

17. The dual-band EBG ESA of claim 16 wherein the low-frequency phase shifter has approximately twice an aperture size of the high-frequency phase shifter.

18. The dual-band EBG ESA of claim 13 wherein the frequency selective surface comprises a periodic surface of identical elements that exhibits a frequency dependent behavior.

19. The dual-band EBG ESA of claim 18 wherein the frequency selective surface comprises a plurality of unit cells etched on high-frequency material substrates.

20. The dual-band EBG ESA of claim 13 wherein the frequency selective surfaces are disposed on an FSS slat that extends vertically through the EBG ESA such that every other slat of the dual-band EBG ESA is an FSS slat.

* * * * *